US009647307B2

(12) United States Patent
Zhou

(10) Patent No.: US 9,647,307 B2
(45) Date of Patent: May 9, 2017

(54) TUNABLE FILTER AND DUPLEXER INCLUDING FILTER

(71) Applicant: Huawei Technologies Co., Ltd., Shenzhen, Guangdong (CN)

(72) Inventor: Yanzhao Zhou, Milan (IT)

(73) Assignee: Huawei Technologies Co., Ltd., Shenzhen (CN)

( * ) Notice: Subject to any disclaimer, the term of this patent is extended or adjusted under 35 U.S.C. 154(b) by 87 days.

(21) Appl. No.: 14/524,400

(22) Filed: Oct. 27, 2014

(65) Prior Publication Data

US 2015/0042413 A1 Feb. 12, 2015

Related U.S. Application Data

(63) Continuation of application No. PCT/CN2012/086836, filed on Dec. 18, 2012.

(30) Foreign Application Priority Data

Apr. 28, 2012 (CN) ..... 2012 1 0132184

(51) Int. Cl.
*H01P 1/205* (2006.01)
*H01P 1/208* (2006.01)

(52) U.S. Cl.
CPC ..... *H01P 1/208* (2013.01); *H01P 1/2053* (2013.01)

(58) Field of Classification Search
CPC ..... H01P 1/202; H01P 1/2053; H01P 7/04; H01P 1/205; H01P 7/06
USPC ..... 333/206, 207, 222, 223, 224, 226, 231, 333/232, 235
See application file for complete search history.

(56) References Cited

U.S. PATENT DOCUMENTS 2,402,443 A 6/1946 Peterson
2,851,666 A 9/1958 Kach
3,252,116 A * 5/1966 Painter ..... H01P 7/04 333/229
4,292,610 A 9/1981 Makimoto et al.
4,380,747 A 4/1983 Curtinot et al.
(Continued)

FOREIGN PATENT DOCUMENTS

CH 613358 A 9/1979
CN 1272967 A 11/2000
(Continued)

*Primary Examiner* — Barbara Summons
(74) *Attorney, Agent, or Firm* — Leydig, Voit & Mayer, Ltd.

(57) ABSTRACT

A filter includes a plurality of resonance cavities, where a resonance tube and a tuning bolt penetrating into space enclosed by the resonance tube are disposed in each resonance cavity; further includes a tuning part disposed between the tuning bolt and the resonance tube, where the tuning part and the resonance tube form a first capacitor, and the tuning part and the tuning bolt form a second capacitor; and further includes an adjusting structure used for rotating the tuning part, so as to change relative areas between the tuning part and the resonance tube and between the tuning part and the tuning bolt, so that the first capacitor and the second capacitor change synchronously. In the present invention, the tuning part is disposed between the tuning bolt and the resonance tube, so that the tuning part forms a double-capacitor structure with the resonance tube and the tuning bolt.

9 Claims, 7 Drawing Sheets

(56) References Cited

U.S. PATENT DOCUMENTS

| | | | | | |
|---|---|---|---|---|---|
| 4,437,076 | A | | 3/1984 | Makimoto et al. | |
| 5,475,875 | A | * | 12/1995 | Katsuyama | H04B 1/18 327/408 |
| 5,682,128 | A | * | 10/1997 | Huang | H01P 7/04 335/216 |
| 6,081,175 | A | | 6/2000 | Duong et al. | |
| 6,320,483 | B1 | | 11/2001 | Raty et al. | |
| 7,456,711 | B1 | | 11/2008 | Goldsmith | |
| 2003/0197579 | A1 | | 10/2003 | Kegasa et al. | |
| 2005/0040916 | A1 | * | 2/2005 | Park | H01P 1/2053 333/203 |
| 2009/0058563 | A1 | | 3/2009 | Seo et al. | |

FOREIGN PATENT DOCUMENTS

| | | | |
|---|---|---|---|
| CN | 1452267 | A | 10/2003 |
| CN | 201117780 | Y | 9/2008 |
| CN | 101820091 | A | 9/2010 |
| CN | 102324601 | A | 1/2012 |
| CN | 102683773 | A | 9/2012 |
| EP | 0035922 | A1 | 9/1981 |
| EP | 00355922 | A1 | 9/1981 |
| FR | 2149130 | A5 | 3/1973 |
| GB | 2478938 | A | 9/2011 |
| JP | 58111404 | A | 7/1983 |
| KR | 100122231 | A | 12/2011 |
| KR | 101094762 | B1 | 12/2011 |
| SU | 974431 | A1 | 11/1982 |
| WO | WO 2008139499 | A1 | 11/2008 |
| WO | WO 2009056813 | A1 | 5/2009 |

* cited by examiner

TUNABLE FILTER AND DUPLEXER INCLUDING FILTER

CROSS-REFERENCE TO RELATED APPLICATIONS

This application is a continuation of International Patent Application No. PCT/CN2012/086836, filed Dec. 18, 2012, which claims priority to Chinese Patent Application No. 201210132184.8, filed Apr. 28, 2012, both of which are hereby incorporated by reference in their entireties.

TECHNICAL FIELD

The present invention relates to the field of communications devices, and in particular, to a tunable filter and a duplexer including the filter.

BACKGROUND

A duplexer of a base transceiver module is formed of RF (radio frequency) cavity filters, is generally located on a mechanical part on a rear side of a transceiver board, and is used for transmitting a single-path high-power signal. The RF cavity filters in the duplexer include a TX filter (transmit channel filter) and an RX filter (receive channel filter). With the development of multi-carrier and multi-standard mobile communications, a demand for platformization gradually grows. For example, a frequency band of DCS (distributed control system), PCS (personal communications service), TD-SCDMA (Time Division Synchronous Code Division Multiple Access), and UMTS (Universal Mobile Telecommunications System) is 1710 to 2170 MHz, and therefore a large number of duplexers of different frequency sub-bands are required. If a filter is bandwidth-tunable, signals of different frequency can be tuned by one duplexer, which is of great significance to improving platformization of a duplexer and saving management and manufacturing costs FIG. 1 shows a single-cavity model of a cavity filter in the prior art, where a resonator 102 is fastened onto a step 101, the resonator 102 is equivalent to an inductor L, an upper surface of the resonator 102 and a cover connected to the top of a tuning bolt 103 are equivalent to a capacitor C, and an equation for calculating resonance frequency Fr of a single cavity is $$Fr = \frac{1}{2\pi\sqrt{LC}}.$$

To make the filter bandwidth-tunable, it needs to be ensured that the resonance frequency of each single cavity is tunable, that is, enabling the equivalent inductor L or the equivalent capacitor C to be tunable or both of them to be tunable. To achieve the objective, the prior art provides various solutions, and examples thereof are given as follows:

As shown in FIG. 2, a US patent US20090058563 discloses a tunable filter. In a dielectric TE (transverse electric wave) mode filter, dielectric tuning parts 203 and sliding members 204 are added between a cavity 201 and a cover 202. By moving bolts 205 that fasten the dielectric tuning parts 203 inside guiding grooves, cavity perturbation between the dielectric tuning parts 203 and dielectric resonators 206 is achieved, thereby changing the resonance frequency. However, because a tuning range of the dielectric filter is relatively small and a tuning range of the dielectric parts is much more limited, the tuning range of such a filter still cannot meet requirements.

As shown in FIG. 3, a Chinese patent with an application number of 201110251164.8 discloses a tunable filter, where an inductance coil 302 is wound over a tuning bolt 301, and currents of different directions and magnitudes are supplied to the inductance coil 302 so as to change inductance, thereby achieving cavity perturbation and further achieving tuning. Although this technical solution can achieve a multi-band filtering function without manual tuning, a position where the tuning bolt and the cover are connected is grounded, and applying a voltage nearly has little influence on the inductance of the inductance coil. In addition, the cavity filter is a typical distributed constant circuit filter and the inductance coil is a low-frequency lumped parameter component; therefore, it is difficult to tune the cavity resonance frequency by changing a inductance value and a current direction of a lumped parameter inductor at high frequency. As a result, the tuning range of the filter is still small, and cannot meet a requirement of tunable wideband, which results in that platformization cannot be achieved.

SUMMARY

The present invention is to provide a tunable filter, so as to solve a problem that a tuning range of a conventional tunable filter is too small to implement platformization.

Embodiments of the present invention are to provide a tunable filter: including a plurality of resonance cavities, where each resonance cavity has a resonance tube and a tuning bolt penetrating into space enclosed by the resonance tube;

further including a tuning part disposed between the tuning bolt and the resonance tube, where the tuning part and the resonance tube form a first capacitor, and the tuning part and the tuning bolt form a second capacitor; and further including an adjusting structure used for rotating the tuning part, so as to change relative areas between the tuning part and the resonance tube and between the tuning part and the tuning bolt, so that the first capacitor and the second capacitor change synchronously.

Another objective of the embodiments of the present invention is to provide a duplexer, including a transmit channel filter and a receive channel filter, where both the transmit channel filter and the receive channel filter perform filtering by using a tunable filter; and the tunable filter includes a plurality of resonance cavities, where each resonance cavity has a resonance tube and a tuning bolt penetrating into space enclosed by the resonance tube;

further including a tuning part disposed between the tuning bolt and the resonance tube, where the tuning part and the resonance tube form a first capacitor, and the tuning part and the tuning bolt form a second capacitor; and further including an adjusting structure used for rotating the tuning part, so as to change relative areas between the tuning part and the resonance tube and between the tuning part and the tuning bolt, so that the first capacitor and the second capacitor change synchronously.

Beneficial Effects

In the embodiments of the present invention, a tuning part is disposed between a tuning bolt and a resonance tube, so that the tuning part, together with the resonance tube and the tuning bolt, forms a double-capacitor structure. Synchronous change of the two capacitors can be achieved by rotating the tuning part by using an adjusting structure, so as to change resonance frequency. Because the two capacitors change synchronously, a tuning range of a filter is larger than a conventional frequency tuning range. As a result, a filter and a duplexer can be truly bandwidth-tunable. Signals of different frequency can be tuned by a duplexer using the filter according to an actual requirement instead of a large number of duplexers of different frequency sub-bands, which achieves platformization of a duplexer and significantly saves management and manufacturing costs.

DESCRIPTION OF EMBODIMENTS

To make the objectives, technical solutions, and advantages of the present invention clearer, the following further describes the present invention in detail with reference to the accompanying drawings and embodiments. It should be understood that, the specific embodiments described herein are merely intended to explain the present invention, but are not intended to limit the present invention.

Figure 1:
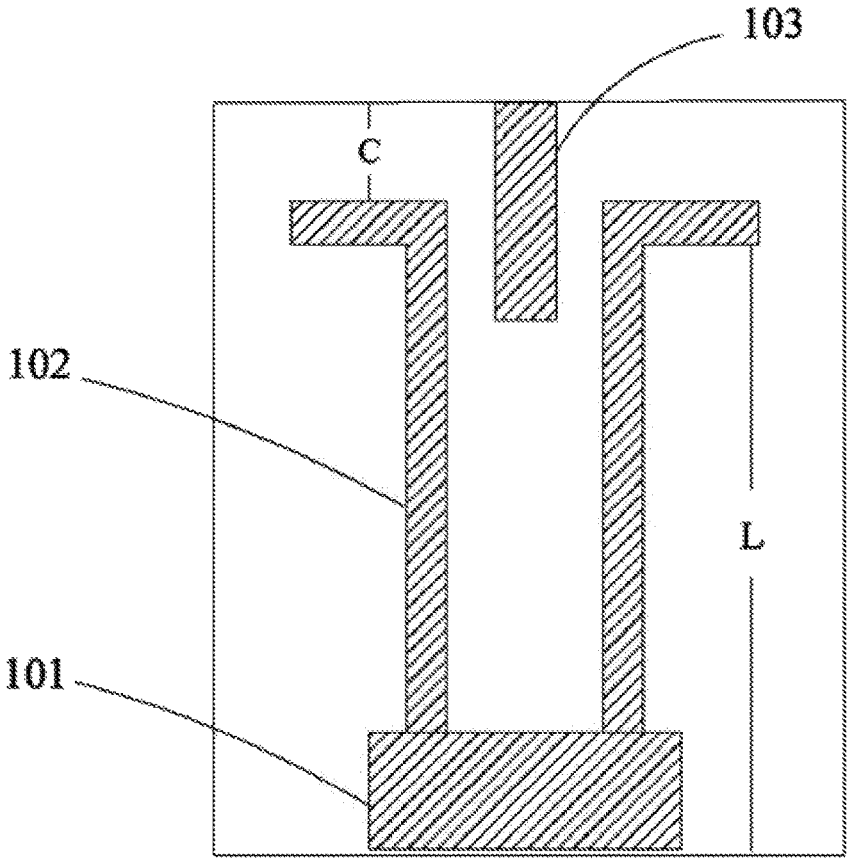
FIG. 1 (Prior Art)
FIG. 1 shows a single-cavity model of a filter in the prior art.
Figure 2:
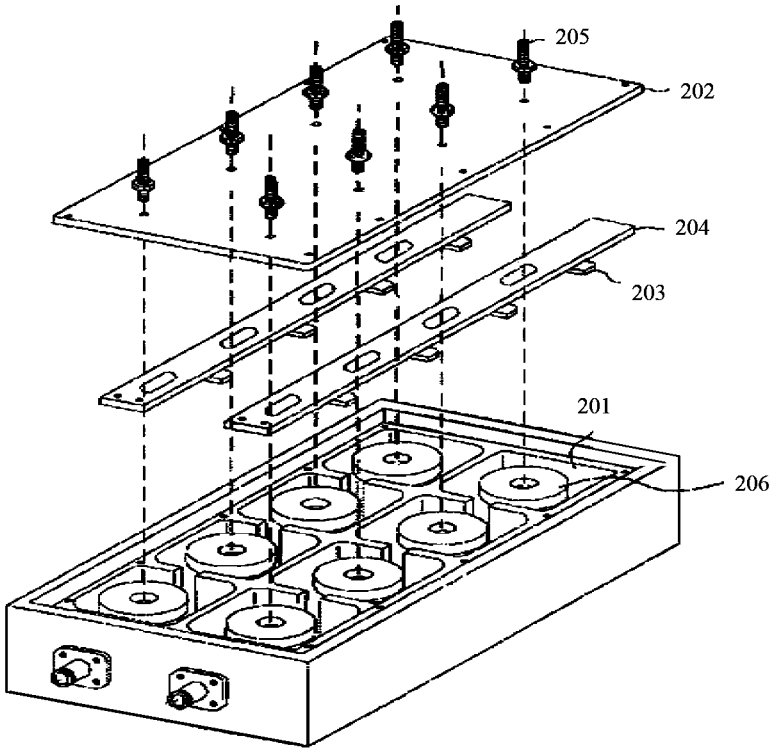
FIG. 2 (Prior Art)
FIG. 2 is a schematic structural diagram of a tunable filter in the prior art.
Figure 3:
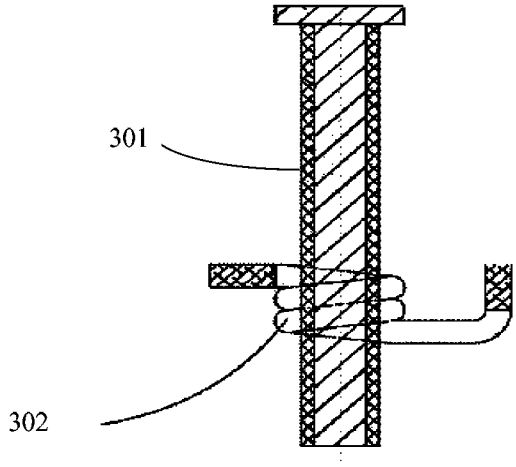
FIG. 3 (Prior Art)
FIG. 3 is a schematic structural diagram of another tunable filter in the prior art.
Figure 4:
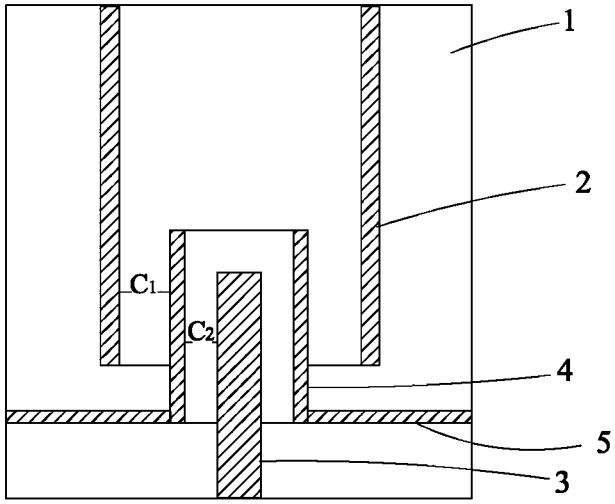
FIG. 4 is a schematic structural diagram of a single cavity of a tunable filter according to an embodiment of the present invention.
Figure 5:
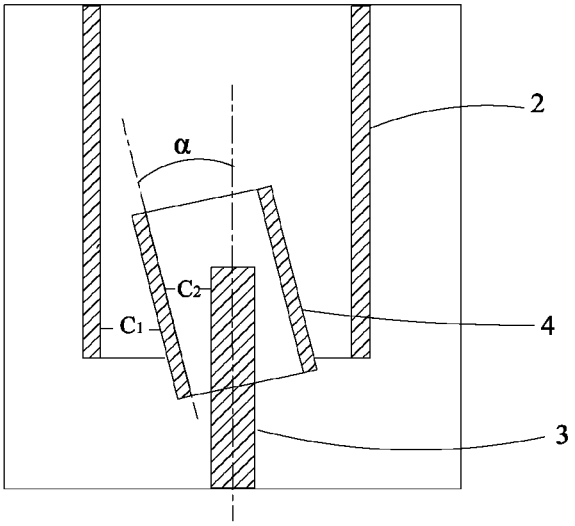
FIG. 5 is an operating principle diagram of a single cavity of a tunable filter according to an embodiment of the present invention.
Figure 6:
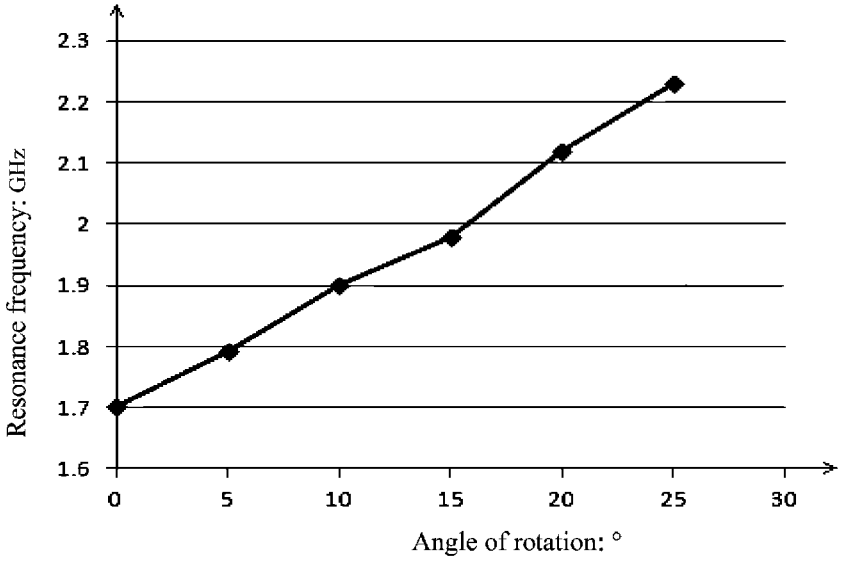
FIG. 6 is a schematic diagram of test data of a tunable filter according to an embodiment of the present invention.

FIG. 4 is a schematic structural diagram of a single cavity of a tunable filter according to an embodiment of the present invention, FIG. 5 is a schematic diagram of an operating state of a single cavity of a tunable filter according to an embodiment of the present invention, and FIG. 6 is a schematic diagram of test data of a tunable filter according to an embodiment of the present invention. For ease of description, only parts related to the embodiments are shown.

As shown in FIG. 4, the tunable filter includes a plurality of resonance cavities 1, where a resonance tube 2 and a tuning bolt 3 are disposed in each resonance cavity 1, and the tuning bolt 3 penetrates into space enclosed by the resonance tube 2. A tuning part 4 is also disposed between the tuning bolt 3 and the resonance tube 2. The resonance tube 2 is equivalent to an inductor L, an exterior wall of the tuning part 4 and an interior wall of the resonance tube 2 are equivalent to a capacitor (a first capacitor) $C_1$, and an interior wall of the tuning part 4 and an exterior surface of the tuning bolt 3 are equivalent to another capacitor (a second capacitor) $C_2$. The tuning part 4, together with the resonance tube 2 and the tuning bolt 3, forms a parallel double-capacitor structure. The resonance tube 2, the turning screw 3, and the tuning part 4 cooperate to form a resonance unit that has a filtering function. The tunable filter further includes an adjusting structure 5 used for rotating the tuning part 4, so as to change relative areas between the tuning part 4 and the resonance tube 2 and between the tuning part 4 and the tuning bolt 3. It can be understood that the tuning part 4 may have a plurality of rotating directions, and the relative areas are changed as long as a central axis of the tuning part 4 rotates relative to central axes of the tuning bolt 3 and the resonance tube 2.

According to a capacitance calculation equation $$C = \frac{\varepsilon S}{4\pi k d},$$

where $$\frac{\varepsilon}{4\pi k}$$

is a constant, S is a relative area between two electrodes of a capacitor, and d is a distance between the two electrodes, when the relative area S and the distance d change, capacitance C changes accordingly, leading to a change in resonance frequency $$Fr = \frac{1}{2\pi\sqrt{LC}}.$$

Referring to FIG. 5, the tuning part 4 in the embodiment of the present invention is driven by the adjusting structure 5 to rotate in any direction relative to a tuning bolt 3 and a resonance tube 2. When the tuning part 4 rotates by a certain angle $\alpha$, both the relative areas and distances between the tuning part 4 and the resonance tube 2 and between the tuning part 4 and the tuning bolt 3 change, so that the first capacitor $C_1$ and the second capacitor $C_2$ change simultaneously, so as to achieve an objective of changing the resonance frequency Fr. Different resonance frequency Fr may be obtained by rotating the tuning part 4 by different angles.

The following provides a set of test data related to the filter according to this embodiment. Refer to Table 1 and FIG. 6:

TABLE 1

Contrast data of angle of rotation of the tuning part and the resonance frequency of the single cavity

| Angle of rotation (°) | 0 | 15 | 25 |
|---|---|---|---|
| Resonance frequency (GHz) | 1.703 | 1.98 | 2.23 |

The rotation angle in the foregoing data is defined as follows: When the tuning part 4, the tuning bolt 3 and the resonance tube 2 are coaxial, the position of the tuning part 4 is taken as an initial position, and after the tuning part 4 rotates by a certain angle, a deflection angle of the central axis of the tuning part 4 relative to the initial position is the angle of rotation. It can be understood that the rotation of the tuning part 4 may be a reciprocating motion and is not limited to rotation in a same direction; therefore, it may be defined that the angle of rotation has a positive value when the tuning part 4 rotates in one direction, and the angle of rotation has a negative value when the tuning part 4 rotates in an opposite direction. The foregoing data only records data when the tuning part rotates in a same direction; however, a tunable wideband can also be achieved when the tuning part rotates in an opposite direction. Detailed data thereof is not listed in this embodiment.

It can be seen from the foregoing data and FIG. 6 that when the angle of rotation of the tuning part 4 varies between 0° and 25°, the resonance frequency of the tuning part 4 increases continuously in a range from 1.703 GHz to 2.23 GHz. Such a wide frequency tuning range can satisfy band requirements of services such as DCS, PCS, TD-SCDMA and UMTS.

It can be understood that the foregoing data is only test data of a specific embodiment of the present invention. The embodiment of the present invention focuses on the variable tuning range of the filter, and for a specific resonance frequency value, a proper adjustment may be made according to an actual requirement. For example, a resonance frequency of 1.5 to 2.0 GHz is actually required, an initial setting may be properly performed for the structures, relative positions and the like of the resonance tube 2, the tuning bolt 3 and the tuning part 4, and different resonance frequencies may be obtained by adjusting the tuning part 4 during practical operation.

In the embodiment of the present invention, the tuning part is disposed between the tuning bolt 3 and the resonance tube 2, so as to form a double-capacitor structure. Synchronous change of the two capacitors can be implemented by using the adjusting structure 5 to rotate the tuning part 4, so as to change the resonance frequency. Because the two capacitors change simultaneously, the tuning range of the frequency of the filter is larger than the frequency tuning range of a conventional filter, so that a wideband tuning range of the filter and the duplexer is actually achieved. During practical use, signals of different bands can be tuned by one duplexer, so that the duplexer is applicable to a plurality of scenarios, which thereby implements platformization of the duplexer and significantly saves management and manufacturing costs. In addition, the filter has a simple structure, and does not need addition of a complex device and control unit, thereby effectively controlling increase of production cost. Besides, because synchronous change of the two capacitors can be achieved by rotating the tuning part in any direction and the rotating fulcrum of the tuning part does not need to be strictly limited, the tuning part is freer in rotation and more flexible in design, and manufacturing is more convenient. Moreover, due to the simple structure, the filter is easier to operate and maintain, which thereby further facilitates platformization of the duplexer.

Further, the resonance tube 2, the tuning part 4, and the tuning bolt 3 may have various specific shapes.

Specifically, the shape of the resonance tube 2 may use, but be not limited to, a round-barrel-shape or a polygonal-barrel-shape. The shape of the tuning part 4 may also use the foregoing shapes, or may be a barrel shape with a longitudinal opening. Similarly, the shape of the tuning bolt 3 also does not need to be strictly limited. Specific shapes of the three shapes may be properly designed according to an actual requirement and based on the manufacturing difficulty as long as they can form the double-capacitor structure.

Preferably, the shapes of the tuning part 4, the resonance tube 2, and the tuning bolt 3 adapt to each other, which can ensure that two electrodes of the first capacitor are parallel to those of the second capacitor, so as to maximize the capacitance and thereby widen the variable range of the capacitor and facilitating manufacturing.

Preferably, the tuning bolt 3 is cylindrical, and both the tuning part 4 and the resonance tube 2 are round-barrel-shaped. Definitely, the three are preferably disposed coaxially. In this way, no matter in which direction the tuning part 4 rotates, as long as angles of rotation are the same, changes of the relative areas and distances are the same, and therefore, changes of the resonance frequency are also the same, If the three do not use the foregoing shapes, for example, the three are all polygonal-cylinder-shaped or the three use different shapes, when the tuning part 4 rotates in different directions, changes of the relative areas and distances may not be the same, that is, for different rotating directions, correspondence relationships between the angle of rotation and the resonance frequency are not the same, but the wideband tuning range of the filter is not affected. In this embodiment, preferably, the tuning bolt 3 is designed as cylindrical, both the tuning part 4 and the resonance tube 2 are designed as round-barrel-shaped, and the three are coaxial. On the one hand, manufacturing is facilitated and design flexibility is improved. On the other hand, in subsequent use, even if the rotating direction of the tuning part 4 changes, the tuning effect of the tuning part 4 remains unchanged, which is conducive to maintaining stable operation performance of the tuning part 4 and is convenient for use and maintenance.

Further, the tuning part 4 may have various rotating directions. Specifically, referring to a three-dimensional coordinate system shown in FIG. 7, FIG. 8, and FIG. 9, Z axis corresponds to a central axis of the tuning part 4 in an initial position.

Figure 7:
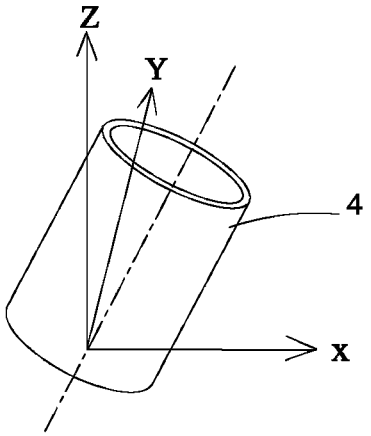
FIG. 7 is a schematic diagram (1) of a rotating direction of a tuning part in a tunable filter according to an embodiment of the present invention.

The tuning part 4 may rotate in a plane where X axis and Z axis are located, as shown in FIG. 7.

Figure 8:
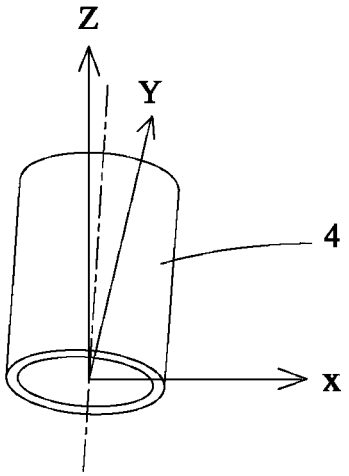
FIG. 8 is a schematic diagram (2) of a rotating direction of a tuning part in a tunable filter according to an embodiment of the present invention.

Alternatively, the tuning part 4 may rotate in a plane where Y axis and Z axis are located, as shown in FIG. 8.

Figure 9:
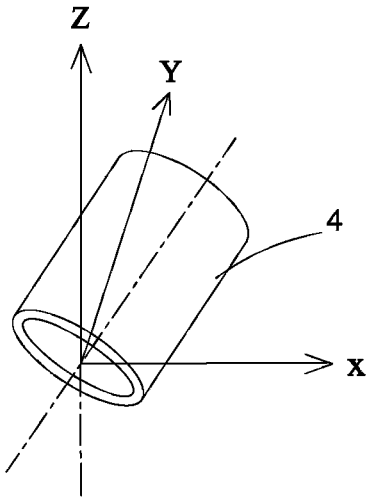
FIG. 9 is a schematic diagram (3) of a rotating direction of a tuning part in a tunable filter according to an embodiment of the present invention.

Alternatively, the tuning part 4 may rotate in a plane which presents an angle of 45° to the plane where Y axis and Z axis are located and to the plane where X axis and Z axis are located, as shown in FIG. 9.

Definitely, the rotation may also be in another plane where the relative areas and distances between the tuning part 4 and the resonance tube 2 and between the tuning part 4 and the tuning bolt 3 can also be changed, thereby changing the first capacitor and the second capacitor.

In this embodiment, the number and arrangement manner of the resonance cavities 1 may be determined according to an actual requirement without a strict limitation.

Figure 10:
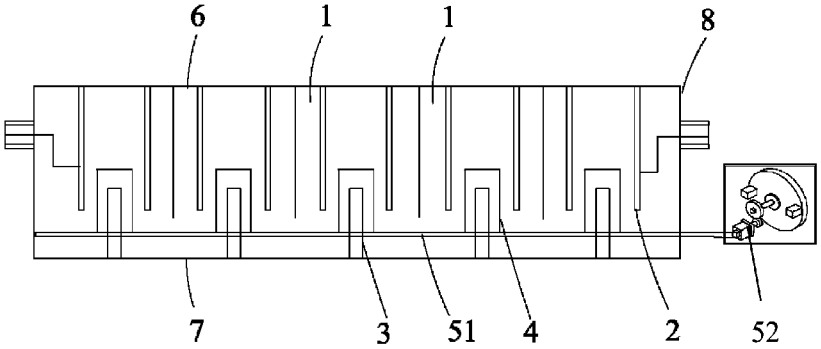
FIG. 10 is a schematic structural diagram of a tunable filter according to an embodiment of the present invention.

Preferably, a plurality of resonance cavities 1 may be arranged in a row by means of straight cavity layout, that is, straight cavity arrangement, as shown in FIG. 10. This arrangement manner facilitates manufacturing, and makes it convenient to dispose the tuning part 4 and control swinging of the tuning part 4.

Figure 11:
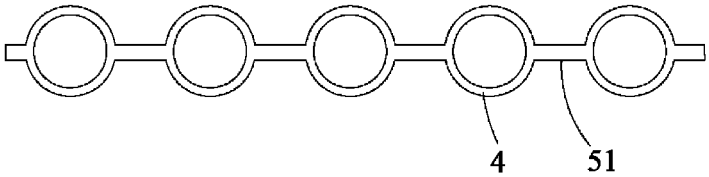
FIG. 11 is a schematic structural diagram of a tuning part in a tunable filter according to an embodiment of the present invention.

Further, referring FIG. 11, the adjusting structure 5 specifically may include a connecting rod 51. This structure is suitable for the filter using the straight cavity arrangement. Ends, which are exposed outside the resonance tube 2, of a plurality of tuning parts 4 may be connected in sequence by the connecting rod 51 to form an integral structure. The connecting rod 51 is rotatable about its central axis to drive the tuning part 4 to rotate.

Preferably, the central axis of the connecting rod 51 may be orthogonal to the central axis of the tuning part 4, that is, the two intersect and are perpendicular. Definitely, the tuning part 4 and the tuning bolt 3 are generally disposed coaxially, and the central axis of the connecting rod 51 is also orthogonal to the central axis of the tuning bolt 3. When the central axis of the connecting rod 51 is orthogonal to the central axis of the tuning part 4, the center of gravity of the tuning part 4 is located exactly above the connecting rod 51, which is conducive to maintaining stability of the tuning part 4, facilitates adjusting the rotation of the tuning part 4, and makes it convenient to establish a correspondence relationship between the angle of rotation and the resonance frequency in the manufacturing stage.

Further, the adjusting structure 5 may further include a driving unit 52 connected to one end of the connecting rod 51 to drive the connecting rod 51 to rotate in an axial direction, so as to drive the plurality of tuning parts 4 to rotate simultaneously. This control unit has a simple structure and is easy to operate.

Specifically, the driving unit 52 may use a stepper motor or a gear transmission control mechanism, and may be any unit that can drive the connecting rod 51 to rotate around its central axis.

It can be understood that the adjusting structure 5 in the embodiment of the present invention is not limited to the foregoing structure, and other proper designs may also be made according to an actual requirement, as long as the adjusting structure can enable the tuning part 4 to swing relative to the resonance tube 2 and the tuning bolt 3.

In this embodiment, the rotation angle range of the tuning part 4 may be determined according to an actual requirement. When the angle of rotation is excessively large, contact with the tuning bolt 3 or the resonance tube 2 may occur, resulting in short circuit. When the angle of rotation is excessively small, the frequency tuning range is too small to satisfy the requirement for a wideband tuning range.

Preferably, under the premise of ensuring that the tuning part 4 does not contact the tuning bolt 3 and the resonance tube 2, the angle of rotation of the tuning part 4 may be limited to −45° to 45°. It can be known from the data recorded in Table 1 that in a rotating range of 0° to 25°, the resonance frequency can satisfy the band requirements of DCS, PCS, TD-SCDMA and UMTS, and in this case, if the angle of rotation is increased to 45°, the resonance range of the filter can be further increased, so that the filter has a wider tuning range and is applicable to more application scenarios. It can be understood that during the rotation of the tuning part 4 in a forward direction and a reverse direction, the adjustment effects of the tuning part 4 are symmetrical. That is, the effects of adjusting from 0° to 45° and adjusting from 0° to −45° are the same, and definitely, the effects of adjusting from 45° to 0° and from −45° to 0° are also the same.

Figure 12:
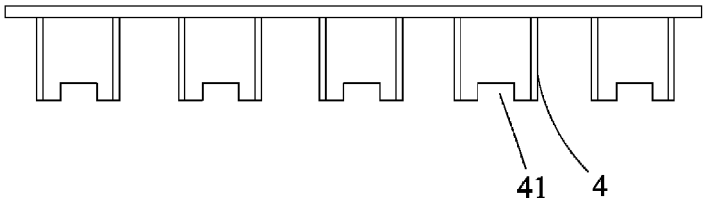
FIG. 12 is a schematic structural diagram of an improved tuning part in a tunable filter according to an embodiment of the present invention.
Figure 13:
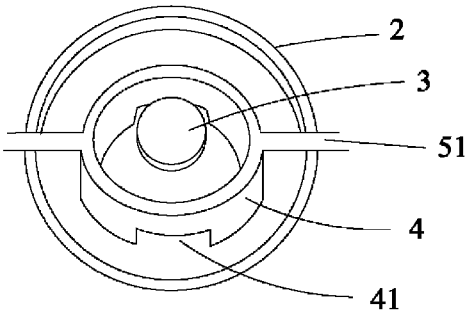
FIG. 13 is a schematic structural diagram of a single cavity of a tunable filter using an improved tuning part according to an embodiment of the present invention.

Further, referring to FIG. 12 and FIG. 13, as an improvement of the embodiment of the present invention, to avoid contact between the tuning bolt 3 and the tuning part 4, two notches 41 of the tuning part 4 that are opposite to each other are formed at one end which is hidden inside the resonance tube 2, and an axis of the two notches 41 is consistent with a rotating direction of the tuning part 4. When the angle of rotation of the tuning part 4 is excessively large and therefore an end of the tuning part 4 is about to contact the tuning bolt 3, the notch 41 can provide a certain safety margin for the tuning bolt 3, so as to avoid contact between the tuning bolt 3 and the tuning part 4 and thereby further improve stability and safety of the filter.

Specifically, width of the notches 41 may be slightly larger than diameter of the tuning bolt 3, and the height of the notches 4 may be determined according to a preset angle of rotation, so as to ensure the tuning bolt 3 does not contact bottoms of the notches 41.

In this embodiment, the tuning part 4 and the tuning bolt 3 may use a metal material, so as to provide a wider tuning range.

In this embodiment, the filter may further include a first cover 6 and a second cover 7 disposed opposite to each other. As shown in FIG. 4, the resonance tube 2 and the tuning bolt 3 are fastened onto the first cover 6 and the second cover 7 respectively. The second cover 7 is movable along a central axis of the tuning bolt 3 to change a depth by which the tuning bolt 3 is inserted into the resonance tube 2, so as to change the second capacitor, thereby changing the resonance frequency.

Specifically, the resonance tube 2 and the tuning bolt 3 may be fastened onto the respective covers by using screws or other parts. The second cover 7 may move under the control of a corresponding control apparatus, and specifically, an existing control manner may be used, which is not described in detail herein.

Definitely, the filter has a housing 8, as shown in FIG. 10. In the housing 8, space enclosed by the housing may be divided into a plurality of resonance cavities 1 by using any component. Each resonance cavity 1 has a resonance unit formed by the resonance tube 2, the tuning part 4, and the tuning bolt 3. A specific cavity design manner does not need to be specifically limited. In addition, the first cover 6 and the second cover 7 may be two opposite surfaces of the housing 8, and may also be two cover plates additionally provided in the housing 8, but the present invention is not limited thereto.

In the filter provided by the embodiment of the present invention, the tuning part 4 is additionally disposed between the resonance tube 2 and the tuning bolt 3, so as to form a double-capacitor structure. By using the adjusting structure 5 to drive the tuning part 4 to rotate relative to the resonance tube 2 and the tuning bolt 3, the objective of changing the two capacitors synchronously to change the resonance frequency is achieved. Compared with a conventional filter with tunable dielectric and a tunable inductor, the filter with two capacitors that change synchronously has a wider tuning range. Compared with a conventional filter with a tunable capacitor but without a tuning part, the tuning range of the filter can also be increased by 50%. A duplexer using the filter can satisfy the tuning requirement of a wide band, which is of great significance to achieving platformization of a duplexer and reducing management and manufacturing costs.

The above embodiments are merely exemplary embodiments of the present invention, but are not intended to limit the present invention. Therefore, any modification, equivalent replacement and improvement made without departing from the principle of the present invention shall fall within the protection scope of the present invention.

What is claimed is:

1. A tunable filter, comprising:

a plurality of resonance cavities each having a resonance tube and a tuning bolt, the tuning bolt penetrating into space enclosed by the resonance tube;

a tuning part disposed between the tuning bolt and the resonance tube so as to form a first capacitor with the resonance tube and to form a second capacitor with the tuning bolt, the tuning part penetrating into space enclosed by the resonance tube; and an adjusting structure configured to rotate the tuning part so as to change relative areas between the tuning part and the resonance tube and between the tuning part and the tuning bolt, so that the first capacitor and the second capacitor change synchronously.

2. The tunable filter according to claim 1, wherein a shape of the tuning part matches a shape of the resonance tube.

3. The tunable filter according to claim 2, wherein both the resonance tube and the tuning part are round-barrel-shaped, and the tuning bolt is cylindrical.

4. The tunable filter according to claim 1, wherein the adjusting structure comprises a connecting rod, wherein the plurality of resonance cavities are arranged in a row, wherein the tuning part is connected to the connecting rod to form an integral structure, and wherein the connecting rod may rotate in an axial direction to drive the tuning part to rotate.

5. The tunable filter according to claim 4, wherein the adjusting structure further comprises a driving unit connected to one end of the connecting rod and used to drive the connecting rod to rotate in an axial direction.

6. The tunable filter according to claim 1, wherein an angle of rotation of the tuning part is −45° to 45°.

7. The tunable filter according to claim 1, wherein the tuning part comprises two notches formed opposite to each other at an end of the tuning part located inside the resonance tube, and wherein an axis of the two notches is consistent with a rotating direction of the tuning part.

8. The tunable filter according to claim 1, wherein both the tuning part and the tuning bolt comprise a metal material.

9. The tunable filter according to claim 1, further comprising a first cover and a second cover disposed opposite to each other;

wherein the resonance tube is fastened onto the first cover and the tuning bolt is fastened onto the second cover, and wherein the second cover is configured to move along a central axis of the tuning bolt so as to change the second capacitor.

* * * * *